United States Patent [19]

Tomkinson et al.

[11] Patent Number: 4,780,698

[45] Date of Patent: Oct. 25, 1988

[54] CIRCUIT INTERRUPTER DEVICE AND METHOD FOR MAKING

[75] Inventors: Donald Tomkinson, North Attleboro; John R. D'Entremont, Foxboro, both of Mass.

[73] Assignee: Texas Instruments Incorporated, Dallas, Tex.

[21] Appl. No.: 44,866

[22] Filed: Apr. 30, 1987

[51] Int. Cl.[4] ..... H01H 45/02; H01H 37/04

[52] U.S. Cl. ..... 337/113; 337/372; 337/380

[58] Field of Search ..... 337/113, 112, 89, 85, 337/381, 380, 372, 365, 362

[56] References Cited

U.S. PATENT DOCUMENTS

| | | | |
|---|---|---|---|
| 3,064,100 | 11/1962 | Malone | 337/113 |
| 3,311,725 | 3/1967 | Butler et al. | 337/365 |
| 3,909,767 | 9/1975 | Williamson et al. | 337/260 |

*Primary Examiner*—H. Broome

*Attorney, Agent, or Firm*—James P. McAndrews; John A. Haug; Melvin Sharp

[57] ABSTRACT

A resettable, current-responsive, circuit interrupter device has two wide but thin terminals embedded up to a substantial part of their thickness in a side wall of an insulating housing so that sides of the embedded terminal portions are exposed from the housing material along the side wall inside the housing. Terminal ends extend from the bottom of the housing to be connected in a circuit and extend through the top of the housing to be accessible for test purposes. An electrical contact is mounted on the exposed side surface of one embedded terminal portion and a thermostatic strip element is secured to the exposed side surface of the other embedded terminal portion to extend closely along the one housing side to normally engage the contact in a very compact, closed circuit position of the device. A lid overlies the thermostatic strip element. The thermostatic strip element has a selected resistivity and the wide terminals have substantial current capacity so the thermostatic strip self-heats to a selected temperature to open the circuit in response to occurrence of a precisely predetermined overload current condition in the device circuit at any ambient temperature likely to be encountered in an automotive environment.

11 Claims, 4 Drawing Sheets

CIRCUIT INTERRUPTER DEVICE AND METHOD FOR MAKING

BACKGROUND OF THE INVENTION

The field of this invention is that of devices for interrupting an electrical circuit in response to the occurrence of an overload current in the circuit, and the invention relates more particularly to low cost, resettable, current-responsive circuit interrupting devices which are sufficiently compact to be accommodated in an automotive fuse block in substitution for fuses for protecting an automotive electrical system.

Automotive electrical systems typically include one or more fuse blocks to accommodate the relatively large number of fuses necessary for protecting different portions of the circuit against current overloads. In one desirable fuse block arrangement, fuse terminals and an integral fuse element connecting the terminals are blanked from a flat metal strip and enclosed in a thin wafer-like housing. A large number of such thin fuses can be very compactly accommodated in slot-like openings in a small fuse block to provide one-shot protection for automotive circuits by interrupting the circuits in response to occurrence of selected current overloads. The fuses provide good response over the wide range of ambient temperatures encountered in the automotive environment, are manufactured at low cost, are easily adapted to provide desired high current capacity, are very compactly accommodated in a fuse block, and also permit convenient diagnostic testing of the circuits via the fuse terminals. Resettable circuit interrupter devices or circuit breakers have been proposed for performing this protective function for automotive circuits but previously known circuit breakers intended for this purpose have been expensive and bulky and have usually required separate discrete connection into each portion of the automotive circuit to be protected. It would be desirable if circuit interrupter devices used to protect some of those automotive circuits were resettable for restoring the circuit functions after a fault condition has been corrected or to permit the circuit to operate at least intermittently for safety purposes for example until action can be taken to correct a fault condition, particularly if such circuit interrupting devices could be made at sufficiently low cost and could be compactly accommodated in existing automotive fuse blocks or the like in substitution for known fuses.

BRIEF SUMMARY OF THE INVENTION

It is an object of this invention to provide a novel and improved circuit interrupter device; to provide such a device which is resettable; to provide such a device which is particularly adapted for low cost manufacture; to provide such a device which is adapted to be very compactly accommodated in an automotive fuse block; to provide such a circuit interrupter device which is adapted to be accommodated interchangeably with known, compact, wafer-like fuse structures; to provide such circuit interrupters which are adapted to operate in response to precisely predetermined current overload conditions for protecting the circuits against overload currents and the like in the various ambient temperatures likely to be encountered in automotive environments; to provide such circuit interrupters which are automatically resettable; to provide such circuit interrupters which are selectively resettable; and to provide novel and approved methods for making such circuit interrupter devices.

Briefly described, the improved resettable circuit interrupter device of this invention comprises a housing of electrical insulating material which mounts a pair of terminals in a novel way to cooperate with a thermostatic means to form a very compact device with precisely predetermined current-response characteristics at widely different ambient temperatures. Each terminal has portions thereof which are embedded in one side wall of the device housing so that side surfaces of the respective, embedded terminal portions are exposed from the housing material in spaced side-by-side relation to each other inside the housing, so that one end of each terminal extends from the bottom of the housing to be connected in an electrical circuit, and preferably so that an opposite end of each terminal extends through the top of the housing to be accessible for circuit test purposes. Preferably the terminals are relatively wide and long but very thin and are embedded up to a substantial part of their thickness in the housing side wall so the exposed side surfaces of the embedded terminal portions are substantially flush with the side wall inside the housing.

A first, stationary electrical contact means is secured to the exposed side surface of one embedded terminal portion. A thermostatic element such as a generally flat, thermostat metal strip having a dished portion thereof intermediate its ends has one end secured to the exposed side surface of the other embedded terminal portion and extends closely and compactly along the one housing side wall inside the housing to engage a movable electrical contact carried at its opposite end with the stationary contact, thereby to close an electrical circuit between the terminals. The dished portion of the thermostat metal strip element has an original curvature in its closed circuit position as described but is adapted to move with snap action to an inverted dished curvature to open the device circuit when the thermostat metal strip is heated to a predetermined actuating temperature. A housing lid is secured to the portion of the housing previously described to compactly overlie the thermostat metal strip and permit the resulting thin housing structure to be accommodated in an automotive fuse block or the like. The structure is also polarity independent to permit easy accommodation in the fuse block.

The thermostat metal strip is provided with a selected electrical resistivity and the wide but thin device terminals are adapted to provide a relatively large current-carrying capacity such that, when the device is connected in an automotive circuit in ambient temperatures which vary widely over the range encountered in automotive environments, the temperature of the thermostat metal strip is primarily determined by self-heating of the strip in response to the electrical current in the device circuit. Accordingly the device is adapted to open the device circuit in response to a precisely predetermined overload current in the circuit whether the ambient temperature is very low or very high.

In a preferred method for making the circuit interrupter device, the terminals are blanked from a thin, flat metal strip in a desired, spaced, side-by-side relation to each other and are maintained in connected relation to each other, and to other pairs of terminals blanked from the strip in sequence, by carrier portions of the strip. A first portion of the device housing is then molded onto the spaced terminals for forming the top and bottom of the housing as well as the side wall of the housing in which the terminals are embedded as above described. The first electrical contact is then formed on the exposed side surface of one embedded terminal portion, preferably in situ by a weld and coin operation, and the thermostat metal strip is welded to the exposed side surface of the other embedded terminal portion. Preferably an access opening for a resistance welding electrode is provided in said one housing side for facilitating welding of the thermostat metal strip, and preferably the thermostat metal strip is provided with a relatively long projection weld adapted to provide a long weld extending along the length of that embedded terminal portion to provide substantial current-carrying capacity at the weld location to avoid development of a hot spot at that location such as might otherwise alter the response characteristics of the device.

DESCRIPTION OF THE DRAWINGS

Other objects, advantages and details of the novel and improved circuit interrupter device and method of this invention appear in the following detailed description of preferred embodiments of the invention, the detailed description referring to the drawings in which.

DESCRIPTION OF THE PREFERRED EMBODIMENTS

Figure 3:
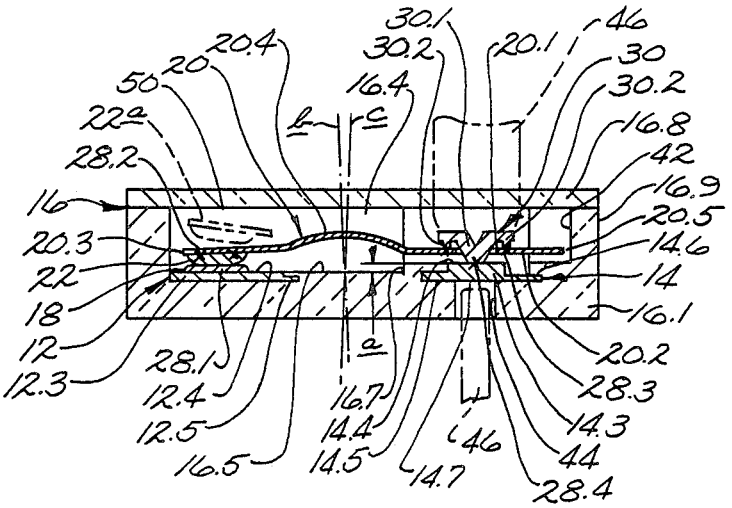
FIG. 3 is a section view along line 3—3 of FIG. 2.
Figure 4:
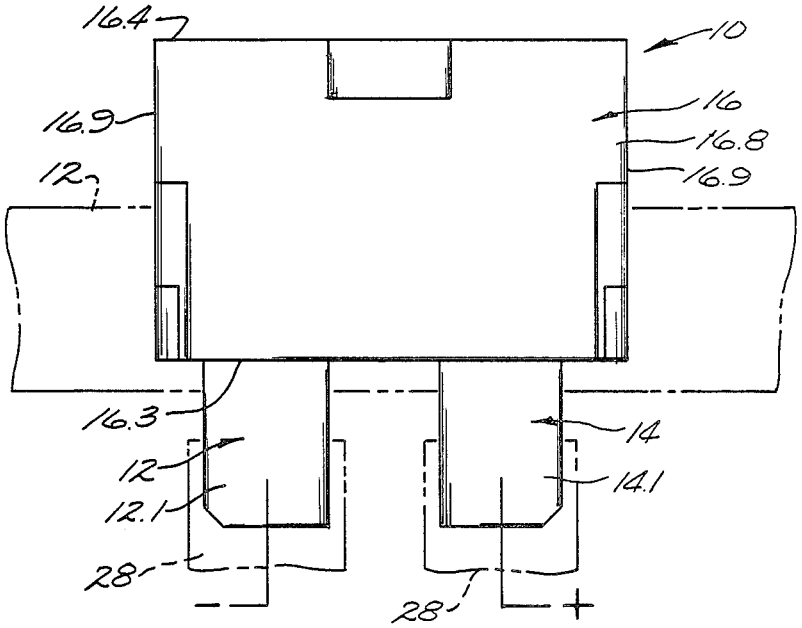
FIG. 4 is a side elevation view of the device of FIG. 2.

Referring to the drawings, 10 in FIGS. 1–4 indicates the novel and improved circuit interrupter device of this invention which is shown to include a pair of terminals 12 and 14 mounted in an electrically insulating housing 16. As shown in FIG. 3, a first or stationary electrical contact means 18 is provided on one of the terminals 12 within the housing and a thermostatic means 20 is provided on the other terminal 14 for moving a complementary, movable electrical contact means 22 into and out of engagement with the first contact means 18 to close and open an electrical circuit between the terminals in response to changes in temperature of the thermostatic means 20.

Figure 1:
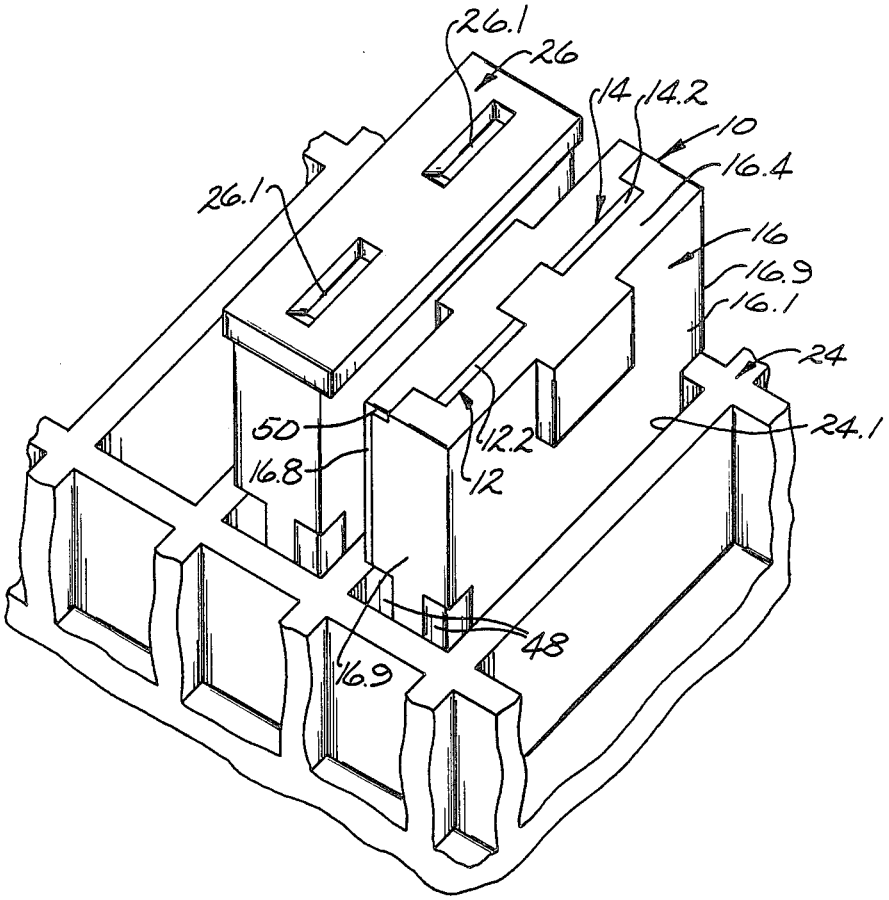
FIG. 1 is a partial perspective view of an automotive fuse block accommodating the novel and improved circuit interrupter device of this invention.
Figure 2:
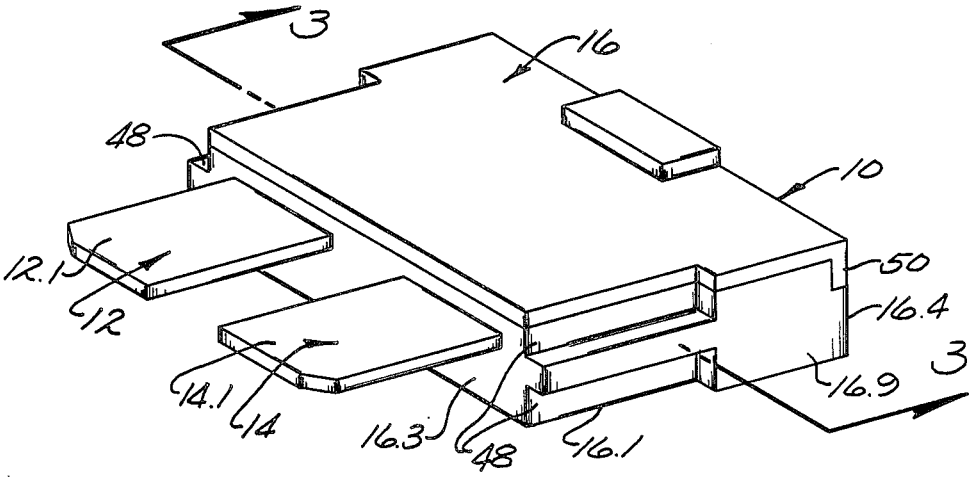
FIG. 2 is a perspective view of the circuit interrupter device of FIG. 1.

In accordance with this invention, the device 10 is provided with a novel structure to be inserted into an automotive fuse block 24 or the like as illustrated in FIG. 1 to be accommodated in a thin slot 24.1 in the fuse block interchangeably with the conventional fuses 26 which are typically used in such fuse blocks. In that regard, a conventional fuse as shown in U.S. Pat. No. 3,909,767 has a thin, wafer-like structure so that a substantial number of the fuses can be very compactly accommodated in a fuse block and each fuse has a pair of terminals (not shown) extending into the fuse block for connecting the fuse into an automotive electrical system, whereby the different fuses provide a one-shot type of overload current protection for respective portions of the automotive circuit. The conventional fuse also has openings 26.1 therein permitting access to the fuse terminals so they can be used when desired to facilitate testing of portions of the automotive circuit. The circuit interrupter device 10 of this invention has a comparably compact, thin, wafer-like structure such that it is adapted to be accommodated in a correspondingly thin slot in a fuse block while being further adapted to provide a resettable type of overload current circuit protection for respective portions of the automotive circuit. The device 10 also has terminal ends 12.1, 14.1 extending from the device to be engaged with mating connectors in the fuse block as indicated by the broken lines 27 in FIG. 4, and has opposite terminal ends 12.2, 14.2 disposed at the top of the device 10 to be accessible for circuit test purposes as illustrated in FIG. 1.

In accordance with this invention, the novel and improved structure of the device 10 is achieved by providing terminals 12 and 14 which are relatively wide and long but very thin and by providing each of the terminals with a portion 12.3, 14.3 which is embedded in one of the side walls 16.1 of the electrically insulating housing so that an upper side surface 12.4, 14.4 of each terminal (as viewed in FIG. 3) is exposed from the material of the housing within the housing chamber 16.2, so that first ends 12.1, 14.1 of the terminals pass through and extend from a second or bottom side 16.3 of the housing adjacent to said one side wall to be connected in a circuit, and so that opposite terminal ends 12.2, 14.2 extend through a third or top side 16.4 of the housing opposite the second housing side to be accessible for test purposes. Preferably the noted terminal portions are embedded in spaced side-by-side relation to each other up to a substantial portion of their thickness in the housing side wall so the exposed side surfaces 12.4, 14.4 of the embedded terminal portions are substantially flush with the inner surface of the housing side wall. In that way the terminals are very compactly accommodated in the device even though wide terminals having substantial current-carrying capacity are used. The terminals also tend to extend over a major portion of the side wall to reinforce the principal side wall of the device as will be understood. In a preferred embodiment, the embedded terminal portions 12.3, 14.3 extend in respective parallel planes at different levels such that there is a small spacing between the planes as indicated at a in FIG. 3, so that inner surfaces 16.5 and 16.6 of the housing side wall are substantially flush with the respective side surfaces 12.4, 14.4 of the terminal adjacent thereto, and so that there is a step 16.7 formed in the side between the terminals. Preferably each terminal also has a portion 12.5, 14.5 of relatively reduced thickness formed by coining or the like which is fully embedded in the material of the housing side wall 16.1 for securely locking the terminal within the side wall. Preferably also, the terminal 14 has an additional edge portion 14.6 of reduced thickness for a purpose to be described below.

In accordance with this invention, the first electrical contact 18 is preferably formed of a material such as silver or the like having high electrical conductivity and preferably a low contact surface resistance. The first contact is preferably welded to the exposed side surface 12.4 of one terminal as indicated at 28.1 in FIG. 3. The thermostatic means 20 preferably comprises a multi-layer thermostat metal strip element (only one layer being shown for clarity of illustration) which is welded to the exposed side surface 14.4 of the other terminal in similar manner. Preferably for example, the thermostat metal strip has a slit 20.1 extending substantially across the width of the strip adjacent one strip end 20.2, and has the movable contact 22 formed of a similar high electrical conductivity, low contact resistance material welded to the opposite strip end 20.3 as indicated at 28.2 in FIG. 3. A weld slug 30 having a long weld projection 30.1 formed thereon and having a series of smaller weld projections 30.2 formed around the long weld projection is disposed at the end 20.3 of the thermostat metal strip so that the small weld projections 30.2 are welded to the thermostat metal strip around the slot 20.1 as indicated at 28.3 in FIG. 3 and so that the long weld projection 30.1 extends through the slit 20.1 to be welded to the terminal 14 as indicated at 28.4. In that arrangement, the thermostat metal strip 20 extends closely and compactly along the housing side wall 16.1 for normally engaging the movable contact 22 with the stationary contact 18 to close an electrical circuit between the terminals 12 and 14, the thermostat metal strip being movable in response to change in its temperature to open the circuit as will be understood. The contact pair 18 and 22 is substantially accommodated within the spacing a provided between the planes of the terminals 12 and 14, and a housing lid 16.8 is secured closely over the thermostat metal strip to facilitate insertion of the device 10 into a fuse block or the like. Preferably bosses 23 are also provided on the housing to facilitate such insertion.

In a preferred embodiment of the invention, the thermostat metal strip 20 has a dished portion 20.4 intermediate its ends, the dished portion having an original curvature as shown in FIG. 3 and being disposed with a concave side of the original dished configuration facing the housing side 16.1 when the thermostat metal strip is in its normal, closed circuit position as illustrated in FIG. 3. However the dished portion of the thermostat metal strip is adapted to move with snap action to an inverted dished curvature when the strip is heated to a predetermined actuating temperature, thereby to move the movable contact means to an open circuit position as indicated by the broken lines 22*a* in FIG. 3 as will be understood. The thermostat metal strip is adapted to return to its original curvature with snap action for resetting the device and reclosing the device circuit when the thermostat metal strip is subsequently cooled to a predetermined resetting temperature. Preferably the thermostat metal strip is disposed within the housing chamber 16.2 so that the central access of the dished portion of the disc as indicated at b in FIG. 3 is disposed obliquely relative to a line c normal to the planes of the terminals 12 and 14 for inclining the thermostat metal strip end 20.3 toward the housing side 16 to be more compactly accommodated within the housing chamber 16.2.

In the preferred embodiment of this invention, the terminals 12 and 14 are relatively wide for providing the device with substantial current-carrying capacity and are preferably formed of a material such as copper or brass having relatively high electrical conductivity such that very little heat tends to be generated in the terminals during device operation. The weld projection 30.1 is also arranged to be very long and extend along a substantial part of the length of the embedded terminal portion 14.3 so that the substantial current can be carried through the weld 28.4 without tending to create a hot spot at the weld location. The thermostat metal strip 20 is then provided with a substantial electrical resistivity relative to the terminals 12 and 14 such that the thermostat metal strip tends to self-heat by electrical resistance heating when electrical current is directed through the device circuit and such that the temperature of the strip is primarily determined by such self-heating with little contribution from heat generated in the terminals during device operation even when the device is operated at the widely different temperatures ranging from −40 to +120 degrees C. likely to be encountered in automotive environments. In that arrangement, the device 10 is adapted to open the device circuit at precisely predetermined actuating temperatures of the thermostat metal strip in response to the occurrence of a precisely predetermined overload current in the circuit at the various ambient temperatures.

Figure 5:
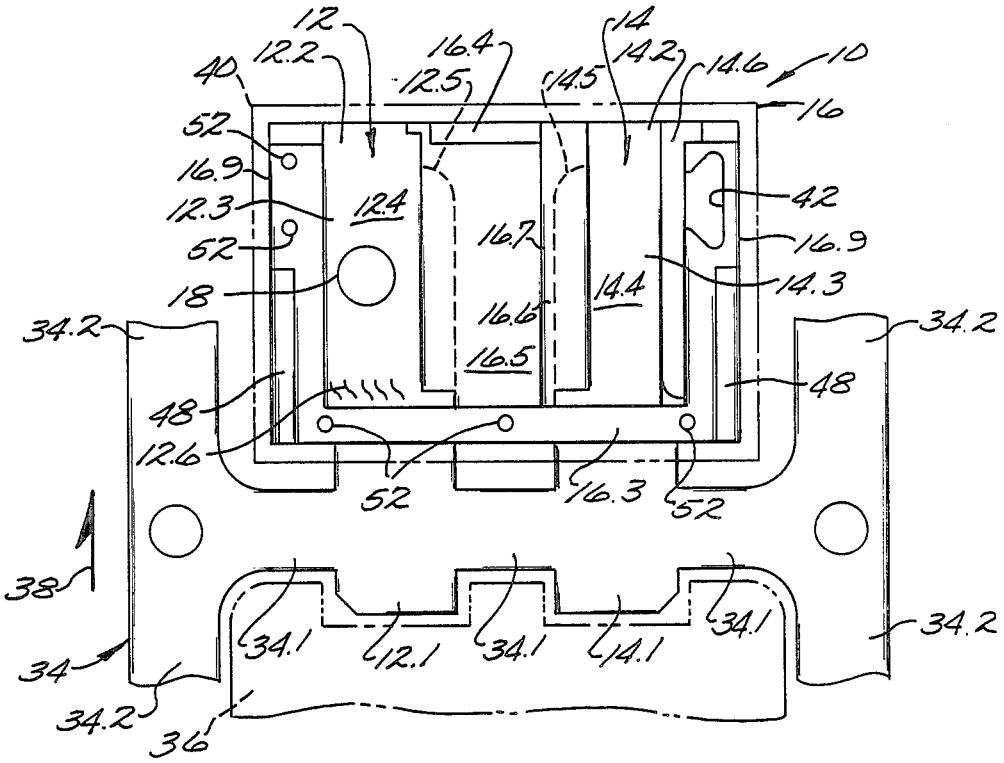
FIG. 5 is a side elevation view similar to FIG. 4 illustrating the device with the housing lid and other components removed in a stage of the method of making the device as provided by this invention.

In the preferred method of this invention for forming the circuit interrupter device 10, the pair of terminals 12 and 14 are preferably blanked from a thin, flat strip 34 of electrically conductive metal material such as copper, brass or steel or the like as is diagrammatically indicated at 36 in FIG. 5. The pair of terminals are preferably blanked with a desired spacing therebetween, are maintained in connected relation to each other with that spacing by carrier portions 34.1 of the strip, and are held by other carrier portions 30.2 of the strip in connected relation with other pairs of terminals (not shown) which are blanked from strip in sequence as indicated by the arrow 38 in FIG. 5. Preferably the coined portions 12.5, 14.5 of the terminals and the reduced thickness portion 14.6 of one of the terminals are also formed during this blanking stage of the method and preferably the terminal portions 12.3, 14.3 are disposed in their desired spaced, parallel planes relative to each other by bending the terminal 12 during this blanking stage as indicated by the bend in the terminal 12 at 12.6 in FIG. 5.

In the method of this invention, a first portion of the housing including the side wall 16.1, the top and bottom walls 16.2, 16.3, and the lateral side walls 16.9 are molded around the terminals 12 and 14 by injection molding or the like as is diagrammatically indicated by the mold means 40 in FIG. 5, thereby to embed the terminal portions 12.3, 14.3 in the side wall 16.1 and to extend the terminal end through the top and bottom side walls 16.2, 16.3 of the housing as above described. Preferably one of the lateral housing walls 16.9 adjacent to the terminal 14 is provided with a key-shaped slot 42 during the molding stage as illustrated in FIG. 5 and preferably the housing side wall 16.1 is provided with a molded weld-electrode access opening 44 extending along the back side 14.7 of the terminal 14 as is best shown in FIG. 3. In a preferred embodiment of the invention, the housing is molded of polytetraphthalate material or the like providing the housing with a rigid, strong structure suitably attached to the terminals 12 and 14 embedded therein. However other known electrically insulating housing materials are also used within the scope of this invention.

Figure 6:
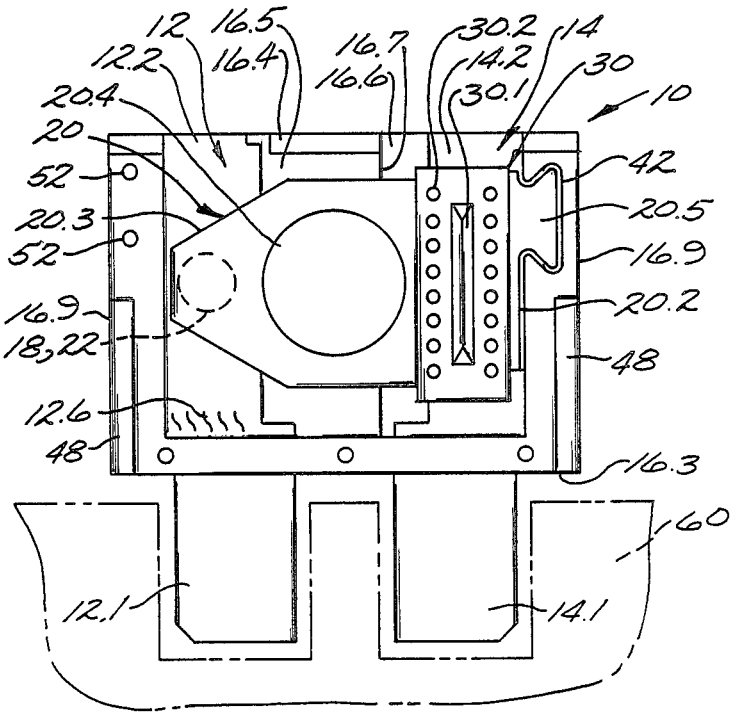
FIG. 6 is a side elevation view similar to FIG. 5 illustrating the device with additional components added in a further step in the method for making the device as provided by this invention.

The stationary electrical contact 18 is preferably formed in situ on the terminal 12 by use of a material of high electrical conductivity such as silver or copper or the like by use of a conventional wire welding and coining technique and the thermostat metal strip is preferably resistance welded to the terminal 14 as is diagrammatically indicated by the weld electrodes 46 in Figure 3. In that welding procedure, the thermostat metal strip is easily rotated about an axis defined by the line of engagement of the long weld projection 30.1 with the terminal 14 to assure that the movable contact 18 engages the contact 22 with a desired contact pressure at a selected temperature and the weld 28.4 is formed to maintain that desired contact pressure. The thermostat metal strip 20 preferably has a key-shaped locating tang 20.5 which fits within the key-shaped slot 42 in the housing wall to facilitate precise locating of the thermostat metal strip within the housing chamber 16.2, and the reduced thickness edge 14.6 of the terminal which supports the thermostat metal strip permits the strip to be rotated on the noted weld projection axis without interference between the terminal and the thermostat metal strip during locating and welding of the strip to the terminal. The carrier strip portions 34.1 and 34.2 are then blanked from the strip material 34 to separate the terminals 12 and 14 and the other device components secured thereto from the metal strip as is diagrammatically indicated by the blanking tool 60 in FIG. 6, thereby to form a discrete and separate device 10.

In the preferred embodiment of the invention, the side walls 16.9 of the housing are grooved as indicated at 48 to facilitate positioning within the fuse block 24. The housing cover 16.8 is preferably provided with a lip portion 50 to fit down over the terminals 12 and 14 and to cooperate with the housing top side wall portion 16.4 for closing the housing chamber 16.2. Preferably the lateral and bottom side walls of the housing having openings 52 molded therein and the housing lid 16.8 has mating projections (not shown) to fit in those openings to assure precise positioning of the lid on the housing. Preferably the lid is secured to the housing by means of an adhesive material or the like (not shown) as will be understood. In that arrangement, the novel and improved circuit interrupter device 10 is adapted for low cost, repetitive manufacture so the device is adapted for interchangeable use with low cost fuses and the like as previously described.

Figure 7:
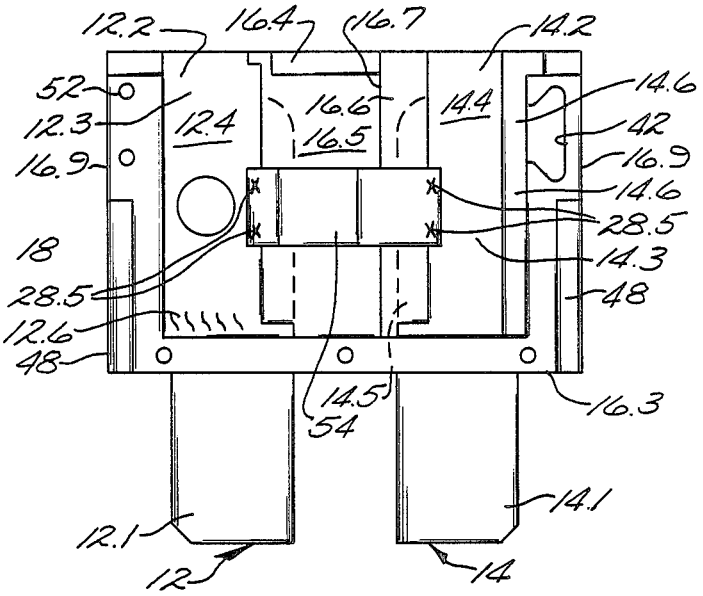
FIG. 7 is a side elevation view similar to FIG. 5 illustrating an alternate embodiment of the device and method of this invention.

In another alternate embodiment of this invention as illustrated at **10*a* in FIG. 7, wherein the same or corresponding reference numerals identify corresponding device components, an electrical resistance heater element 54 formed of an electrical resistance material such as a strip of resistive carbon deposited on a polyimide support such as Kapton or the like, preferably having a positive temperature coefficient of resistivity, has its opposite ends welded to the terminals 12 and 14 as indicated at 28.5 in FIG. 7. The heater element has selected resistivity characteristics such that, when the thermostat metal strip is in closed circuit position, the principal device current passes through the thermostat metal strip and the heating of the thermostat metal strip to its actuating temperature in response to an overload current in the circuit is primarily due to self-heat generated in the thermostat metal strip but so that, when the thermostat metal strip moves to its open circuit position as above described, a small current continues to flow in the heater element 54 sufficient to generate heat for retaining the thermostat metal strip in its open circuit position. In that arrangement, the device 10*a* is adapted to remain in open circuit position until such time as the automotive circuit is selectively de-energized by other means such as opening of the automotive ignition switch, thereby to selectively reset the device 10*a***.

Figure 8:
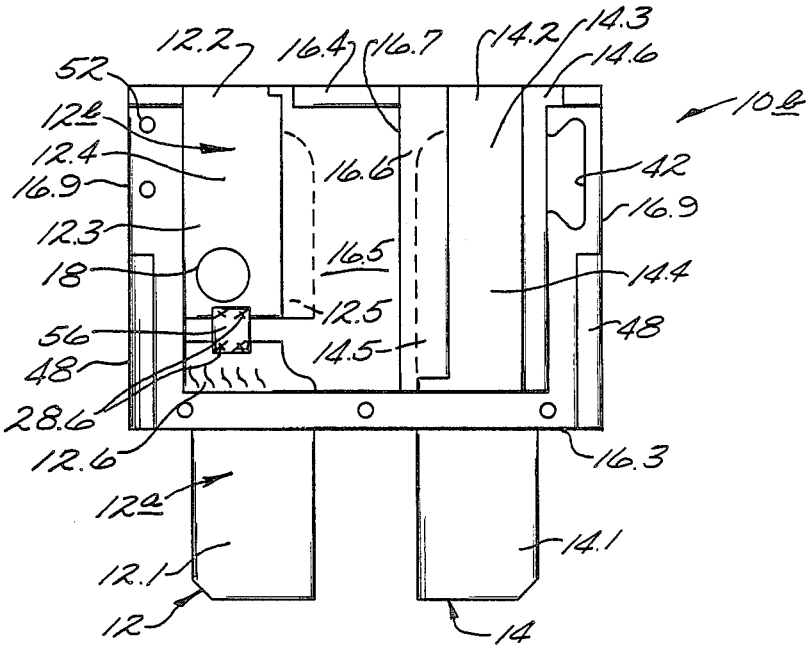
FIG. 8 is a side elevation view similar to FIG. 5 illustrating another alternate embodiment of the device and method of this invention.

In another alternate embodiment of this invention as illustrated at **10*b* in FIG. 8, the device terminal 12 is divided into separate sections 12*a* and 12*b*, and an electrical resistance heater element 56 formed of a nickel alloy material or the like is connected between those terminal sections by welding as indicated at 28.6 in FIG. 8 to be in series with those terminal sections. In this embodiment, the heater element 56** is provided with a selected electrical resistivity to generate sufficient heat during normal device operation for heating and biasing the thermostat metal strip to open the device circuit in response to occurrence of a selected overload current level as may be desired.

It should be understood that although particular embodiments of this invention have been described by way of illustrating the invention, the invention includes all modifications and equivalents of the disclosed embodiments following within the scope of the appended claims.

We claim:

1. A compact circuit interrupting device having relatively high current capacity comprising a housing of electrical insulating material having a pair of terminals mounted thereon, a first contact means on one of the terminals, and a thermostat metal element on the other terminal, the thermostat metal element having movable contact means thereon and being movable between a closed circuit position engaging the contact means and an open circuit position spacing the contact means in response to occurence of selected element temperature, characterized in that the terminals have side surfaces of selected width and length and have a selected relatively much smaller thickness providing the terminals with said high current capacity, selected portions of the terminals are molded in one side of the housing with a substantial part of the thickness thereof embedded in said one side of the housing and attached to the housing material by such molded embedment for compactly mounting the terminals of said high current capacity in spaced side-by-side relation to each other so that attachment of the embedded terminals to the housing material reinforces the housing, so that respective side surfaces of the embedded terminal portions are exposed from material of the housingf at said one housing side, and so that ends of the respective terminals extend from a second side of the housing adjacent said one housing side, the first contact means are disposed on said exposed side surface of the embedded portion of said one terminal, and the thermostat metal element has one end secured to the exposed side surface of the embedded portion of said other terminal and extendss closely along said one housing side in compact relation thereto for moving the movable contact means between said circuit positions in response to occurence of said selected element temperatures.

2. A circuit interrupter device according to claim 1 further characterized in that the terminals have relatively wide and long side surfaces and a relatively much smaller thickness, the embedded terminal portions are embedded in said one housing side wall for a major part of their thickness such that the exposed side surfaces thereof are disposed substantially flush with portions of said one housing side adjacent thereto, and the thermostat metal element is resistance welded in situ to the exposed side surface of the embedded portion of said other terminal, said one housing side having an opening therein providing access to said other terminal at a side surface thereof opposite said exposed side surface for permitting formaing of said in situ resistance weld.

3. A circuit interrupter device according to claim 2 further characterized in that the forst contact means comprises a first contact member welded to the exposed side surface of the embedded portion of said one terminal, the movable contact means comprises a second contact member welded to an opposite end of the thermostat metal element, and the exposed side surfaces of the embedded terminal portions flush with said portions of said one housing side adjacent thereto are disposed in respective, substantially parallel planes having a space between said planes accomodating the contact members therein.

4. A circuit interrupter device according to claim 3 further characterized in that the thermostat metal element has a dished portion intermediate its ends movable woth snap action from an original dished configuration to an inverted dished configuration when heated to a selected actuating temperature and movable to return to said original dished configuration with snap action when subsequently cooled to a selected relatively lower reset temperature, and the thermostat metal element is secured to said other terminal with a concave side of said original dished configuration disposed in facing relation to said one housing side when the movable contact means is in said closed circuit position the thermostat metal element having a principal axis of the dished portion of the thermostat metal element disposed obliquely relative to said one housing side to incline the opposite end of the thermostat metal element toward that housing side for more compactly accomodating the thermostat metal element during said snap action thereof.

5. A circuit interrupter device according to claim 4 further characterized in that the embedded portions of the terminals have selected portions thereof of relatively lesser thickness fully embedded in said one housing side for locking the embedded terminal portions therein.

6. A circuit interrupter device according to claim 4 further characterized in that said one housing side and said exposed surfaces of the embedded terminal portions cooperate in defining one side of a thin housing chamber accommodating the thermostat metal element therein, a housing lid is secured to the housing in closely overlying relation to the thermostat metal element for defining an opposite side of the thin housing chamber, and the second housing side having said one terminal ends extending therefrom is relatively narrow to be compactly accommodated in a fuse block.

7. A circuit interrupter device according to claim 6 further characterized in that said third housing side is also relatively narrow and opposite ends of the terminals embedded in said one side for reinforcing thereof extend completely through the third housing side for further reinforcing the housing and to be accessible at an outer surface of the third side for test prposes when the device is accommodated in a fuse block the third side being open over the exposed surfaces of the embedded terminal portions extending through the third side, and the lid having lip portions fitted against the exposed surfaces of the embedded terminal portions at the third side for closing the housing.

8. A circuit interrupter device according to claim 4 further characterized in that the thermostat metal element has selected electrical resistance properties for carrying a selected normal current while maintaining the movable contact means in closed circuit position and for being self-heated to said selected actuating temperature in response to occurrence of a predetermined overload current in the element, the terminals having a selected size and electrical conductivity to have relatively greater current-carrying capacity than the thermostat metal element for carrying said currents without effecting significant alteration of the overload current required for opening the device circuit during device operation in the various ambient temperatures likely to be encountered in an automotive environment.

9. A circuit interrupter device according to claim 8 further characterized in that said one end of the thermostat metal element is secured to said other terminal by weld means disposed along a relatively long and narrow weld area which has its length extending along a substantial portion of the embedded portion of said other terminal selected to provide sufficient current-carrying capacity at the location of that weld means to avoid development of a hot spot at the weld location such as would result in significant alteration of the overload current required for opening the device circuit during device operation in the various ambient temperatures likely to be encountered in an automobile environment.

10. A circuit interrupter device according to claim 1 further characterized in that an electrical resistance heater element of relatively high resistance properties is connected between said embedded portions of the terminals extending over said one housing side adjacent the thermostat metal element for permitting the device circuit to be effectively opened by movement of the movable contact means to said open circuit position while permitting a small current to flow in the heater for generating and transferring sufficient heat to the thermostat metal element to maintain the movable contact means in said open circuit position.

11. A circuit interrupter device according to claim 1 further characterized in that said one terminal has two discrete parts of said embedded portion thereof mounted on the housing, and an electrical resistance heater element is connected in series relation to those two embedded terminal parts for selectively biasing the thermosta metal elelment to be heated to its actuating temperature in response to a predetermined overload current in the heater element and thermostat metal element.

* * * * *